US007248244B2

(12) United States Patent
Akiyama

(10) Patent No.: US 7,248,244 B2
(45) Date of Patent: Jul. 24, 2007

(54) COLOR DISPLAY DEVICE EMITTING EACH COLOR LIGHT FOR DIFFERENT TIME PERIOD

(75) Inventor: Takashi Akiyama, Sayama (JP)

(73) Assignee: Citizen Holdings Co., Ltd., Tokyo (JP)

( * ) Notice: Subject to any disclaimer, the term of this patent is extended or adjusted under 35 U.S.C. 154(b) by 422 days.

(21) Appl. No.: 10/443,139

(22) Filed: May 22, 2003

(65) Prior Publication Data

US 2005/0035939 A1 Feb. 17, 2005

(30) Foreign Application Priority Data

May 24, 2002 (JP) ..... 2002-149997
May 19, 2003 (JP) ..... 2003-141063

(51) Int. Cl.
*G09G 3/36* (2006.01)

(52) U.S. Cl. ..... 345/102; 345/204; 345/83; 345/690

(58) Field of Classification Search ..... 345/87–104, 345/211–213, 690–692, 82–83, 204; 349/61–64, 349/68–71
See application file for complete search history.

(56) References Cited

U.S. PATENT DOCUMENTS 5,977,942 A * 11/1999 Walker et al. ..... 345/97
6,115,016 A * 9/2000 Yoshihara et al. ..... 345/88
6,188,379 B1 * 2/2001 Kaneko ..... 345/102
6,570,554 B1 * 5/2003 Makino et al. ..... 345/102
6,573,882 B1 * 6/2003 Takabayashi ..... 345/102
6,831,621 B2 * 12/2004 Nakano ..... 345/87
2003/0214725 A1 * 11/2003 Akiyama ..... 359/640
2004/0041781 A1 * 3/2004 Sato et al. ..... 345/102
2004/0239612 A1 * 12/2004 Asao et al. ..... 345/102

FOREIGN PATENT DOCUMENTS

JP 09-274471 * 10/1997
JP 11-052354 A 2/1999
JP 2000-028984 * 1/2000
JP 2000-252063 * 9/2000
JP 2002-105447 * 4/2002
JP 2002-203411 A 7/2002

OTHER PUBLICATIONS

Electronic translation of Japanese publication No. 11-052354.*

* cited by examiner

*Primary Examiner*—Lun-Yi Lao
(74) *Attorney, Agent, or Firm*—Sughrue Mion, PLLC

(57) ABSTRACT

A display device includes a light source that emits a plurality of color lights, and a liquid crystal panel that controls transmission or reflection of the color light from the light source. One field is divided into a plurality of subfields: fr, fg and fb. A specific color light is emitted for at least a partial time of each subfield. An image corresponding to the specific color light is displayed on the liquid crystal panel. Durations of the subfields fr, fg and fb are set to be different from any other subfield in same field. A reflection-type gradation displaying is executed based on a combination of the durations of the subfields.

20 Claims, 8 Drawing Sheets

FIG.9
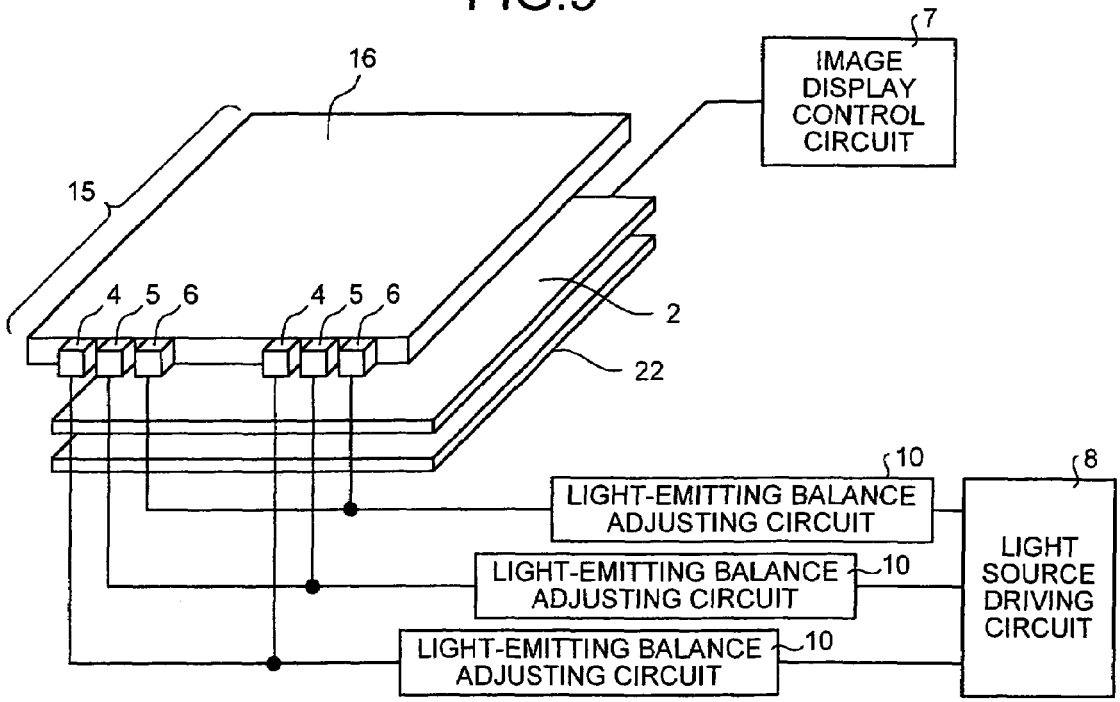
FIG.10 PRIOR ART
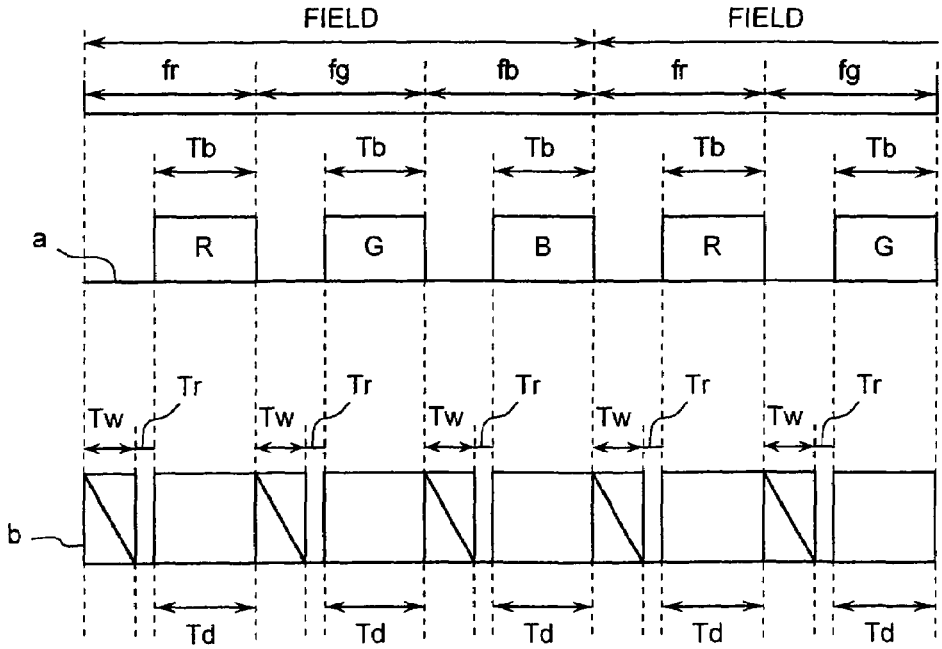

COLOR DISPLAY DEVICE EMITTING EACH COLOR LIGHT FOR DIFFERENT TIME PERIOD

BACKGROUND OF THE INVENTION

1) Field of the Invention

The present invention relates to a field-sequential display device and a method of color displaying using the display device.

2) Description of the Related Art

One of the popular methods of multicolor displaying in a field-sequential display device is to divide a field into several subfields, emit a light of a specific color within a part of a time period of the subfield, and at the same time, display an image that corresponds to the light on an displaying unit, by configuring a display device with a light source that emits a plurality of color lights, each of which can be controlled independently and the displaying unit that controls either of transmission or reflection of the light from the light source and reflection of an external light.

In order to realize the field-sequential display device that can display multiple colors, three color (RGB) light sources with a high speed switching capability is necessary. In the past, since an optimal light source was not available, the field-sequential device was only employed to display specific colors, such as a simple guide plate based on about four colors. However, rapid improvement of blue LEDs and high luminance of green LEDs enabled colors of red, blue and green to be obtained with high luminance, and now the three colors can be used as the light sources of the field-sequential display for displaying full color images with high performance.

Since the red, blue, and green LEDs have a broader color reproduction range on a chromaticity diagram than a color filter display device, colors not conventionally available can now be represented, thereby it is possible to display more faithful and beautiful images. Furthermore, since a color filter is not used, it is possible to obtain a high transmittance and a low electrical power consumption of backlight, resulting in an energy saving effect of a whole system. From these advantages, development of the field-sequential display device is being rapidly advanced (for example, see Japanese Patent Application Laid-Open Publication No. 11-52354 (1999)).

FIG. 10 illustrates display timing of a conventional display device. In the display device, an LED is used as a light emitting element, and a liquid crystal panel is used in a displaying unit. An area "a" indicates light emitting timing of each color in the backlight LEDs arranged on a rear surface of the liquid crystal panel, and an area "b" indicates scanning timing and displaying time of each line on the liquid crystal panel.

In the example shown in FIG. 10, in order to obtain color displaying using an integration effect in the time axis direction of a human eye, a field frequency ("field" shown in FIG. 10) is set to 100 Hz. One field is divided into three subfields and comprises an R subfield fr for turning a red LED on, a G subfield fg for turning a green LED on, and a B subfield fb for turning a blue LED on. As shown in the area "a", each LED of the color corresponding to each subfield emits a light for a fixed emitting time Tb in the latter part of each subfield.

Each subfield of the liquid crystal panel comprises a writing time Tw, a responding time Tr, and a displaying time Td. During the writing time Tw, an electric voltage is supplied based on pixel data while scanning each pixel of the liquid crystal panel sequentially, and transmittance is adjusted. The responding time Tr, which is set to be shorter than the writing time Tw, is from the end of the writing time Tw until obtaining of a desired image on a full screen based on a response of the liquid crystal. The rest is the displaying time Td for which the desired image is displayed.

In the area "a", the light emitting time Tb is set in such a manner that the displaying times are equal, and the LED is turned on only for the displaying time Td. This produces an effect that a color mixing is prevented by allowing the LED to emit only for a time for which the image displaying is defined. If the LED starts to emit the light, for example, during the writing time Tw, an image of a previous subfield remains on a portion where the scanning of each line is not ended or a portion where the liquid crystal does not respond. This results in a time for which the image does not match with the luminescent colors, and this may cause the color mixing.

As described above, the conventional technology emits the LEDs of each color in the backlight sequentially in order of red, green and blue and displays images on the liquid crystal panel corresponding to each color light in synchronization with the light emitting to realize a color display. Furthermore, by using a liquid crystal panel with a capability of displaying multi-gradation, it is possible to realize a display in full-color.

When comparing the color filter type display device with the field-sequential display device, the transmittance of the liquid crystal display device shows a great difference. Since the liquid crystal panel of the field-sequential display device is a simple monochrome one, the transmittance is higher than 35%, while the transmittance of the liquid crystal panel into which a color filter is incorporated is about 10%.

Therefore, even when both devices are used as transmission-type display devices using the backlight, the field-sequential display device enables color displaying with higher brightness in comparison with the color filter display device. When both devices are used as reflection-type display devices using an intense external light, the color filter display device cannot display an image because of a contrast. On the contrary, the field-sequential display device has a merit that a sufficient displaying is possible, and thus it is suggested to use the field-sequential display device both as the transmission-type display device and the reflection-type display device (for example, see Japanese Patent Application Laid-Open Publication No. 2002-203411).

FIG. 11 illustrates a problem occurring when the conventional display device used in a cellular terminal. The cellular terminal 1200 is frequently used in an environment where the external light is bright such as the outdoors, and thus the display device should be visually recognized satisfactorily regardless of the indoors and the outdoors.

In the indoors where the light intensity is relatively low, a sufficient visibility can be obtained as the transmission-type display device by the backlight, however, since the sunlight 1205 with an intensity of nearly 100 times higher than that in the indoors enters a liquid crystal screen 1201 in the outdoors, the visibility in the outdoors becomes greatly lower than the visibility in the indoors. As a countermeasure against this problem, the cellular terminal 1200 can be covered by one hand so that the sunlight 1205 is blocked. However, since the sunlight 1205 is actually a scattered light, the intensity of incident light is not expected to be reduced remarkably, and thus the sufficient visibility cannot be obtained as the transmission-type display device.

With reference to FIG. 12, a reflection-type displaying operation of the field-sequential display device is explained below. When the sunlight 1205 enters the liquid crystal screen 1201, the light is reflected due to a difference in refractive index on an interface between a windscreen 1202 arranged on the liquid crystal screen 1201 and an air layer, and on an interface between a surface of the liquid crystal screen 1201 and the air layer. Before entering the liquid crystal screen 1201, reflected light 1207 that is about 10% of the sunlight 1205 reaches a user.

Since the color filter is not used, the transmittance of the liquid crystal screen 1201 is about 35%. Therefore, 35% of the sunlight in 90% of the sunlight entering the liquid crystal screen 1201 enters and is reflected by the backlight 1203 so as to again enter the liquid crystal screen 1201. If polarized light is not eliminated at this time, the sunlight is not absorbed by the color filter, and thus 100% of the sunlight transmits directly.

The intensity of reflected light 1211 returning to the visible side, therefore, becomes about 32% of the sunlight 1205. The contrast, thereby, becomes as follows:

$$\text{Contrast}=(L\times 42\%)/(L\times 10\%)=4.3$$

This value is about four times as large as that of the color filter display device. When the contrast is 4.3, not only characters but also images can be sufficiently recognized. Brightness of white displaying (L×42%) becomes three times as high as that of the color filter display device, thereby enabling displaying with good visibility. In the field-sequential display device, acceptable reflection-type displaying using the external light, which is impossible in the color filter display device, becomes possible, and thus the field-sequential display device can be used both as the transmission-type display device and the reflection-type display device that can obtain the acceptable visibility in both the indoors and the outdoors.

However, since the conventional technology works basically under a condition that the transmission displaying unit whose light source is the backlight is used, the following problem arises.

In the field-sequential display device according to the conventional technology, as shown in FIG. 5 of Japanese Patent Application Laid-Open No. 11-52354 (1999) and FIG. 6 of Japanese Patent Application Laid-Open No. 2002-203411, the three subfields of R, G and B are obtained by dividing one field into three of the same duration. Transmission-type displaying and reflection-type displaying operations in the field-sequential display device having the subfields of the same duration are explained below with reference to FIG. 13 and FIG. 14. FIG. 13 and FIG. 14 illustrate examples of a color bar displaying, rather than the image displaying, in order to clarify the difference between the transmission-type displaying and the reflection-type displaying.

FIG. 13 is a pattern diagram of display states in various photo-environments. Arrows shown in FIG. 13 relatively indicates the photo-environments: the arrow 13 represents the external light, 0 means that the intensity of light is zero in a dark room or the like, and 100 shows that the intensity of the light is a maximum in the outdoors under fine weather. In the indoors such as a normal office, the intensity of light corresponds to about 30.

On the other hand, the arrow 14 represents the backlight intensity. The backlight intensity is always 10 because it is constant regardless of environments. The bottom left of FIG. 13 illustrates the display state in which the intensity of the external light is zero at the time of displaying the color bars using the field-sequential display device. When the intensity of the external light is zero, a reflected component of the external light does not exist, and thus the emitted light of the color light by means of the field-sequential driving is visually recognized directly as the transmission-type displaying, so that the color bars are displayed with high color saturation.

The bottom right of FIG. 13 illustrates the display state in which the intensity of the external light is 100 corresponding to the outdoors under fine weather. When the external light is stronger than the intensity 10 of the backlight, the transmission-type color displaying using the backlight is hardly recognized visually, and thus the reflection-type displaying using the external light is dominant.

A black color that is displayed on the left end of the color bar displaying in FIG. 13 is visually recognized directly as black. On a blue display section, the transmission-type displaying is obtained only in the subfield fb of FIG. 10, and non-transmission-type displaying is obtained in the other subfields fr and fg. The external light, therefore, reflects only in the subfield fb and does not reflect in the subfields fr and fg. This state for each color is shown in FIG. 14.

The transmission and non-transmission of the liquid crystal panel in each subfield are shown in FIG. 14 by white and black squares. The display color section 17 corresponds to the color bar displaying of FIG. 13 and illustrates the transmission-type display colors by means of the backlight when the intensity of the external light is zero. A gradation display section 18 shows a ratio that black (non-transmission) appears in the three subfields with respect to the respective display colors. This is repeated in the respective fields, and when a human eye recognize that sufficient integration is made during one field, a number of non-transmission appearances can be visually recognized directly as the gradation displaying. That is to say, four-gradation displaying of 0/3, 1/3, 2/3 and 3/3 in the three subfields are executed.

When the intensity of the external light is 100 and thus brighter than the backlight, the reflection monochrome displaying using the external light is visually recognized by the human eye, and as shown in the gradation display section 18, the three colors of blue, red, and green are recognized as the monochrome gradation displaying of 1/3, and three colors of magenta, cyan, and yellow are recognized as the monochrome gradation displaying of 2/3. For example, the color bars are displayed, six kinds of the color displaying from blue to yellow in the bottom left of FIG. 13 becomes only two-gradation displaying including 2/3 gradation displaying and 1/3 gradation displaying in the bottom right of FIG. 13. Six kinds of color displaying contents in the color displaying of the transmission-type displaying are, therefore, displayed with only two gradations in the reflection-type displaying, thereby arising a problem that the contents of the color bars cannot be discriminated.

Even in the case of character displaying or the like other than the color bar displaying, if red characters are displayed on a blue background, for example, when the external light becomes gradually intense and the reflected component is increased, the blue and the red, therefore, become nearly 2/3 gradation displaying, as shown in FIG. 14, and as the external light becomes more intense, it is gradually difficult to discriminate these colors, and then they cannot be discriminated at all. This is applied also to combinations of other colors, and thus the colors that obtain the same gradation in the gradation display section 18 shown in FIG. 14 cannot be discriminated.

When the display device is used in an environment of an intermediate state where the intensity of the external light changes from 0 to 100, the color becomes unnatural. In the field-sequential displaying where the reflection of the external light is taken into consideration, it is natural that the color displaying by means of the backlight is considered to be corresponding to a color adjuster of a television device. That is to say, when the external light is intense, the color displaying by means of the backlight corresponds to a state that the color adjuster narrows down the color.

When the intensity of the external light is 100, the color becomes zero (the backlight becomes invisible) and the transmission-type color displaying shown in the bottom left of FIG. 13 is impossible, but the color bar displaying is replaced by the monochrome bar displaying shown in the bottom right of FIG. 13. It is natural that the monochrome bar displaying becomes monochrome displaying with eight gradations including from black to white of 7/7, 617, 5/7, . . . 1/7 and 0/7 in order of visibility. For example, when green is compared with magenta, if the intensity of the external light is 100, green should be brighter than magenta. As shown in the gradation display section 18 in the bottom right of FIG. 13 and FIG. 14, however, green is 2/3 gradation displaying and magenta is 1/3 gradation displaying, and thus green is darker than the magenta.

That is to say, when the external light changes in the display state, a color component of the reflection-type displaying using the external light is superposed on a color component of the transmission-type displaying using the backlight. The brightness/darkness of green and magenta is inverted in result, the displaying of dark green and bright magenta is obtained, and this is unnatural as the color bar displaying from the viewpoint of the visibility. This is a problem that arises because luminance components and color components of the respective color displaying do not match with each other.

In the conventional technology, as described above, when the reflection-type displaying is executed in an environment that the external light is intense, a display image cannot be recognized with a specific color, and since the color components and the luminance components of the colors do not match with each other, the transmission-type displaying and the reflection-type displaying are brought into an unnatural display state from the view point of the visibility.

SUMMARY OF THE INVENTION

It is an object of the present invention to solve at least the problems in the conventional technology.

The display device according to one aspect of the present invention includes a light source that emits N color lights, where N is a positive integer other than unity, and a displaying unit that controls either of transmission or reflection of the color light from the light source and reflection of an external light, wherein one field is divided into N subfields, a specific color light among the N lights is emitted for at least a partial time of the subfield, a transmission-type color displaying is executed by displaying an image corresponding to the specific color light on the displaying unit, a duration of a subfield is set to be different from a duration of any other subfield in same field, and a reflection-type gradation displaying using the external light is executed based on a combination of the durations of the subfields.

The display device according to another aspect of the present invention includes a light source that emits N color lights, where N is a positive integer other than unity, and a displaying unit that controls either of transmission or reflection of the color light from the light source and reflection of an external light, wherein one field is divided into N subfields, a specific color light among the N color lights is emitted for at least a partial time of the subfield, a transmission-type color displaying is executed by displaying an image corresponding to the specific color light on the displaying unit, the subfield includes a writing time for which image data are written into the displaying unit and a displaying time for which an image is displayed based on the written data, a duration of a displaying time in the subfield is set to be different from a duration of any other displaying time in the subfield in same field, and a reflection-type gradation displaying using the external light is executed based on a combination of durations of the displaying time in the subfields.

The method of color displaying according to still another aspect of the present invention includes dividing one field into N subfields, where N is a positive integer other than unity, emitting a specific color light among the N color lights for at least a partial time in each subfield, displaying an image corresponding to the specific color light, setting a duration of a subfield to be different from a duration of any other subfield in same field, and executing a reflection-type gradation displaying using the external light based on a combination of the durations of the subfields.

The method of color displaying according to still another aspect of the present invention includes dividing one field into a plurality of subfields, emitting a specific color light for at least a partial time in each subfield, and displaying an image corresponding to the specific color light, wherein the subfield includes a writing time for which image data are written into the displaying unit and a displaying time for which an image is displayed based on the written data, a duration of a displaying time in the subfield is set to be different from a duration of any other displaying time in the subfield in same field, and a reflection-type gradation displaying using the external light is executed based on a combination of durations of the displaying time in the subfields.

The other objects, features and advantages of the present invention are specifically set forth in or will become apparent from the following detailed descriptions of the invention when read in conjunction with the accompanying drawings.

BRIEF DESCRIPTION OF THE DRAWINGS

FIG. 9 is a schematic diagram of a display device according to a third embodiment of the present invention;

FIG. 10 illustrates display timing of a conventional display device;

DETAILED DESCRIPTION

Figure 1:
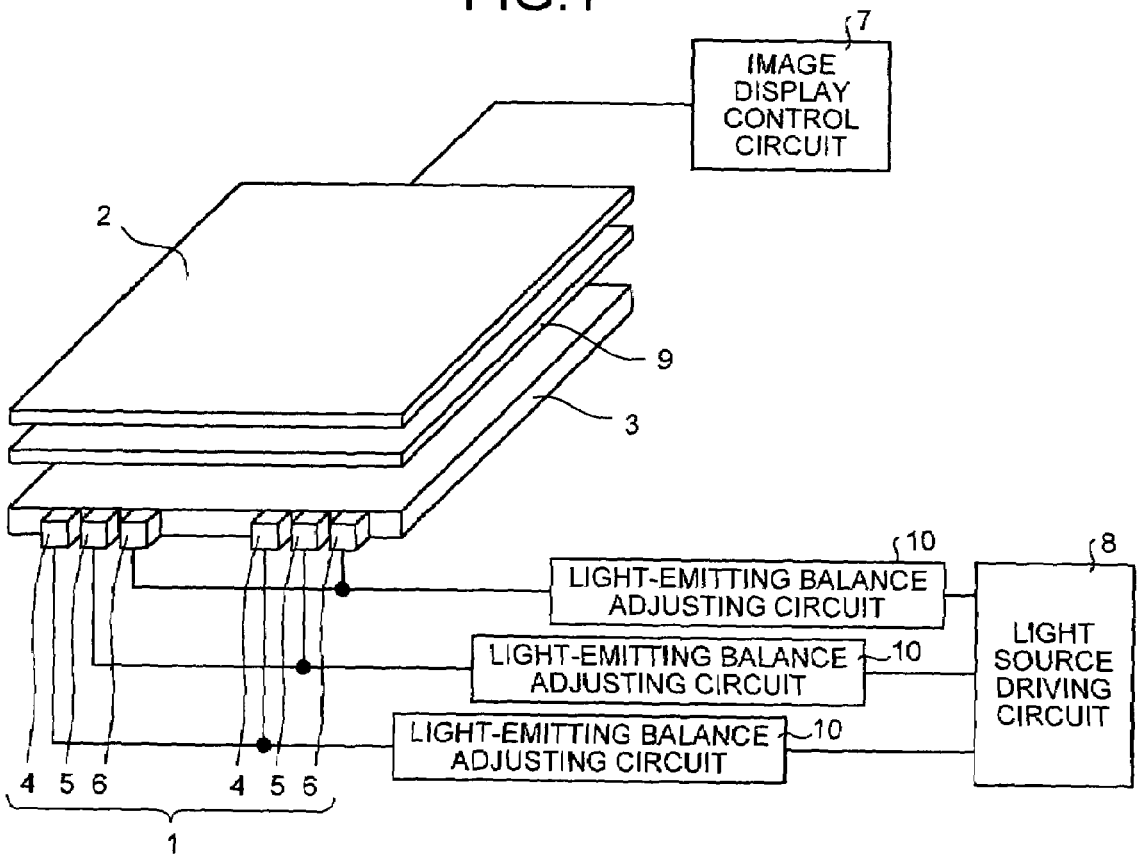
FIG. 1 is a schematic diagram of a display device according to a first embodiment of the present invention.
Figure 2:
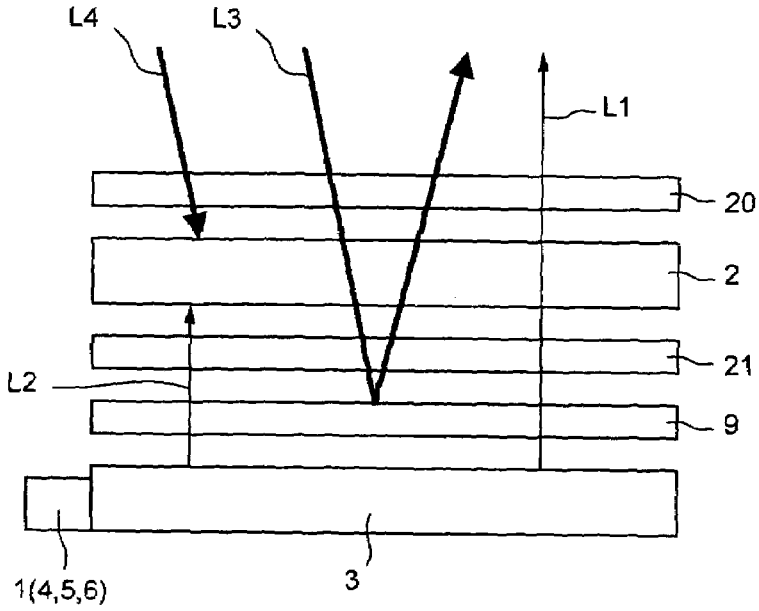
FIG. 2 is a cross section of the display device according to the first embodiment.

Exemplary embodiments of a display device of the present invention are explained below with reference to the drawings. FIG. 1 is a schematic diagram of a display device according to a first embodiment of the present invention. FIG. 2 is a cross section of the display device according to the first embodiment. As shown FIG. 1, the display device of the present invention includes a light source 1 that comprises a plurality of color light sources. The color light sources emit lights of different wavelengths and can be controlled independently. In order to realize a full-color displaying, the light source 1 employs a red LED 4, a green LED 5, and a blue LED 6 arranged on a side surface of a light guide plate 3. The light source 1 is driven by a light source driving circuit 8.

A displaying unit controls transmission of the light from the light source 1. In the first embodiment, a liquid crystal panel 2 is used because it is thin and has good display performance. The liquid crystal panel 2 uses active driving by means of TFT that enables matrix displaying with high contrast even when a high-speed response liquid crystal is used. In the liquid crystal panel 2, an image display control circuit 7 controls timing of transmission of image data, timing of writing into pixels, etc.

The liquid crystal panel 2 is constituted in such a manner that liquid crystal molecules are twisted by 90 degrees between two substrates, and as shown in FIG. 2, upper and lower polarizers 20 and 21 are set to a normally white mode. On one transparent substrate composing the liquid crystal panel 2, one TFT element is arranged on each pixel, and their gate lines and source lines (not shown in the figure) are drawn so as to be connected to the image display control circuit 7 connected with the liquid crystal panel 2. On the liquid crystal panel 2 of the first embodiment, a semi-transmission reflector 9 is provided between the light guide plate 3 composing the light source 1 and the lower polarizer 21. Contrary to a conventional display device in which the external light reflects in the outdoors under fine weather and the visibility is deteriorated, when the external light is bright, even if the light source 1 is switched off, the semi-transmission reflector 9 reflects the external light, so that the display device in the first embodiment obtains sufficient visibility as a reflection-type display device that adopts monochrome displaying.

In the display device of the first embodiment, the liquid crystal panel 2 is controlled by a signal from the image display control circuit 7, so that the transmission/non-transmission/semi-transmission state of each pixel is controlled. One of the red LED 4, the green LED 5 and the blue LED 6 composing the light source 1 emits a color light, and the color light spreads entirely via the light guide plate 3 so as to go out towards the semi-transmission reflector 9.

When, for example, the green LED 5 is switched on, the green color lights L1 and L2 that transmit through the semi-transmission reflector 9 reach the lower polarizer 21, and one of polarized components of the green color lights L1 and L2 is absorbed there, but the other polarized component transmits through so as to reach the liquid crystal panel 2. The green color light L1, which reaches some pixels on the liquid crystal panel 2 controlled into a transmission state, transmits through the liquid crystal panel 2, and further transmits through the upper polarizer 20 so as to be visually recognized. Meanwhile, since the green color light L2 reaches some pixels controlled into a non-transmission state, the color light is not visually recognized, and thus the pixels on this portion are visually recognized as black. After the green LED 5 is switched on for a predetermined time, the green LED 5 is switched off, and the pixels on the liquid crystal panel 2 are controlled into the transmission/non-transmission/semi-transmission state corresponding to the color of the LED to be switched on next by the signal from the image display control circuit 7, so that the same operation is repeated. When the operation is controlled at a high speed, a color, which is obtained by mixing three colors of the lights from the red LED 4, the green LED 5, and the blue LED 6, is visualized by the human eye so as to be visualized as a color image.

In the displaying operation, the operation of controlling the liquid crystal panel 2 into the transmission/non-transmission/semi-transmission state corresponds to a writing time and a responding time in the subfields in the conventional device. The operation including from the switching-on to the switching-off of one LED after the control of the liquid crystal panel 2 corresponds to a displaying time in the subfields.

The control of the respective pixels on the liquid crystal panel 2 and the switching-on control of the LEDs are the same as the aforementioned ones, however, a great difference is that on the pixels where the green color light beam L1 is controlled into the transmission or semi-transmission state, the external light L3 transmits through the upper polarizer 20, the liquid crystal panel 2, and the lower polarizer 21, and reflects from the semi-transmission reflector 9 and again goes out through a reverse route so as to be visualized.

The light on the pixels has a mixed color obtained by the green color light L1 and the external light L3, however, as luminance of the external light is higher, the color of the green color light L1 becomes paler so that the mixed color is visualized as only color of the external light itself (white light). Meanwhile, the external light L4 becomes non-transmitted light on the portions of the pixels on the liquid crystal panel 2 that are controlled into the non-transmission state, so as to be visualized as black in the non-reflection state. As the intensity of the external light is higher, the field-sequential display device in the first embodiment functions as a reflection-type display device.

Figure 4:
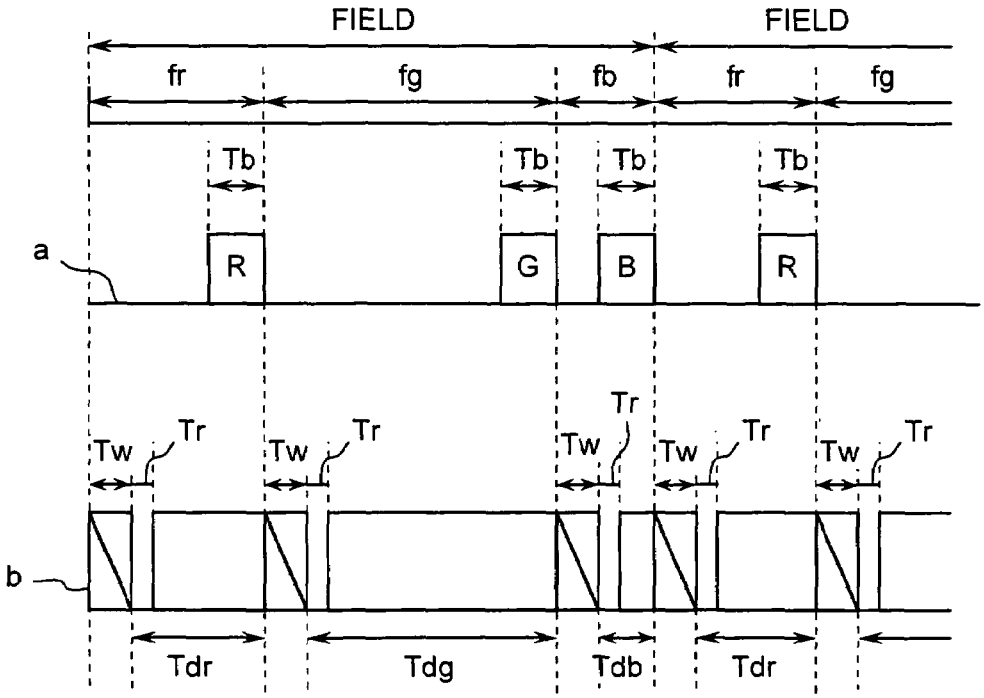
FIG. 4 is illustrates display timing of the display device according to the first embodiment.

An area "a" shown in FIG. 4 indicates a light emitting timing of the LED elements for the respective colors composing the light source 1. An area "b" shown in FIG. 4 indicates an image displaying timing of the liquid crystal panel 2, and indicates a scanning timing and a displaying time.

As shown in FIG. 4, one field includes three subfields: an R subfield fr where the red LED is switched on; a G subfield fg where the green LED is switched on; and a B subfield fb where the blue LED is switched on. In order to attain a color displaying using an integration effect in a time axis direction of the human eye, a field frequency (field shown in FIG. 4) is set to 100 Hz.

The most important characteristic of the present invention is that, as shown in FIG. 4, the subfields fr, fg, and fb have different durations. The durations of the subfields are set in such a manner that the color light of a higher spectral luminous efficiency has the longer duration.

Figure 5:
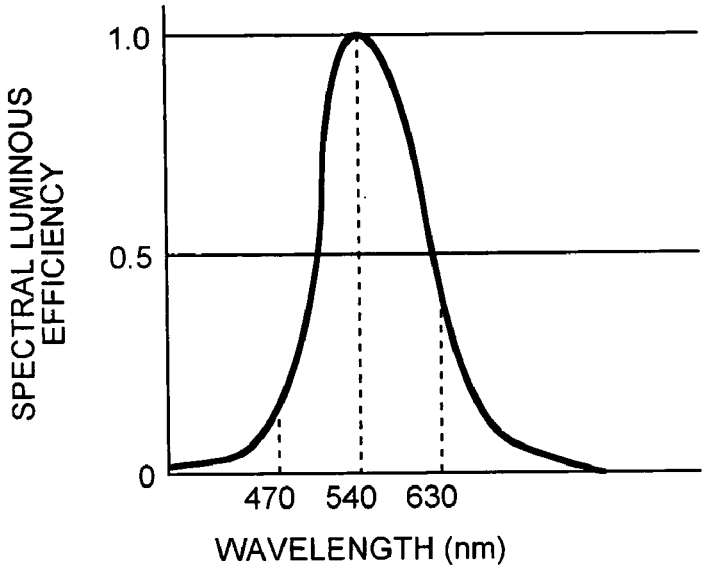
FIG. 5 is a graph of spectral luminous efficiency of each color light.

FIG. 5 is a graph of spectral luminous efficiency of each color light. The vertical axis is the spectral luminous efficiency of the human eye, and the horizontal axis is a wavelength. In the first embodiment, the three color light sources for red, green, and blue are used. The center wavelengths of the blue, green, and red color light sources are 470 nm, 540 nm, and 630 nm, respectively. If the spectral luminous efficiency of green is unity, according to FIG. 4, the spectral luminous efficiency recognized by the human eye becomes higher in order of green, red, and blue. That is to say, when the human views the respective colors under a same condition, green is the brightest, and the brightness becomes lower in order of red and blue.

As shown in FIG. 4, the duration of the subfields is set to be longer in order of green, red, and blue, so that the color lights attain spectral luminous efficiency, which is as close as possible to the graph in FIG. 5.

The characteristic of the first embodiment is that the durations of the subfields are set according to a predetermined ratio. In the example shown in FIG. 4, a ratio between the green subfield fg, the red subfield fr, and the blue subfield fb is set as follows:

$$fg:fr:fb=4:2:1 \quad (1)$$

This ratio does not necessarily match with the spectral luminous efficiency in FIG. 5 completely, and thus they may approximately match with each other. In the first embodiment, the ratio is set to a binary ratio that is easily set as a digital signal according to the equation (1) to make the circuit simple.

In the area "b" of FIG. 4, each of the subfields comprises the writing time Tw, the responding time Tr, and displaying times Tdr, Tdg, and Tdb. For the writing time Tw, while the pixels on the liquid crystal panel are being sequentially scanned, voltage according to image data is applied. The voltage is sequentially applied to the pixels arranged on scanning lines, so that the transmittance is adjusted. The writing time Tw is set to 0.8 ms in the first embodiment. For the displaying time Tdr, Tdg, and Tdb, the transmittance that is adjusted according to the voltage written onto the pixels is maintained, and a desired image is being displayed.

The displaying time Tdr, Tdg, and Tdb in the subfield fr is set to 2.2 ms, 4.8 ms, and 0.8 ms, respectively. The durations of the subfields fr, fg, and fb become 3.0 ms, 5.6 ms, and 1.6 ms, respectively, and the ratio of each field satisfies (1).

In the area "a" of FIG. 4, the time Tb for which LED is switched on is set at the latter half of the displaying time Tdr, Tdg, and Tdb. That is to say, when the switching-on time Tb is shorter than the displaying time Td, the time for which the LED is on is set on time that is just before the end of the displaying time, namely, after time for which the LED is off in the displaying time. This prevents mixing of the colors. When the LED emits the light at the scanning time Tw, for example, an image in the previous subfield remains on a portion where the scanning is not ended or a portion where the liquid crystal does not respond. Time for which the image does not coincide with the luminescent color is generated, thereby occurring the mixing of colors. It is, therefore, necessary to prevent the mixing of colors.

Figure 7:
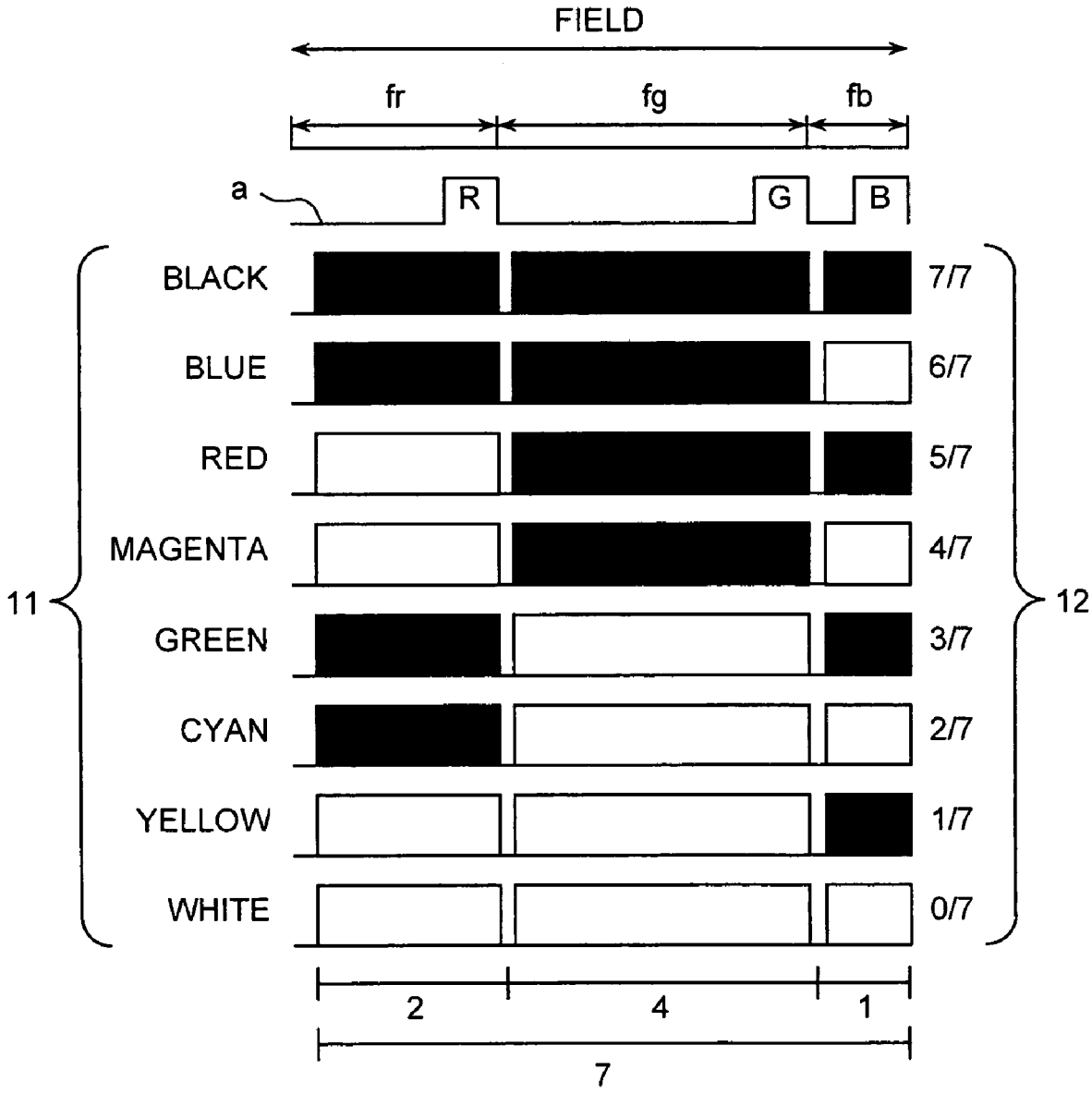
FIG. 7 illustrates an operation of the display device according to the present embodiment.

FIG. 7 is a timing chart that illustrates a typical reflection (transmission) and non-reflection (non-transmission) of the light on the liquid crystal panel 2 in the subfields using white squares and black squares. Light emitting timing "a" indicates the luminescent colors of the LEDs and the light emitting time Tb in FIG. 4. A display color field 11 represents display colors in respective patterns of transmission and non-transmission that can be visualized when an intensity of the external light is less than the light from the light source 1. A gradation display field 12 represents display gradation in respective patterns of reflection and non-reflection of the light.

As shown in FIG. 7, gaps are provided between the subfields in order to discriminate the subfields and make the chart easily understandable, and thus the gaps do not actually exist in the display control. In the actual display device, the portions corresponding to the gaps are transition times or times for which the subfields are switched, and they are not visualized as displaying and are ignorable.

A first pattern (Black) is such that all the subfields are brought into the non-transmission state, and a display color by means of the light source 1 is black. When the light source 1 is switched off or the intensity of the external light is less than that of the light source 1, as shown in the gradation display field 12, the gradation becomes 7/7. The denominator is the duration of one field and is represented by a value obtained by summing up R:G:B:=2:4:1 that is the ratio of the subfields, and it is always 7. The numerator is duration of non-transmission in the field, and since all the subfields are in the non-transmission state, the numerator is 7. That is to say, black is displayed for 7/7 time of the field, and this corresponds to black gradation.

As to a second pattern (Blue), only the blue subfield fb is in the transmission state, and the other subfields are in the not transmission state. As shown in the display color field 11, a display color is blue. When the light source 1 is switched off or the intensity of the external light is less than that of the light source 1, the subfields other than the blue field fb are in the non-transmission state. The numerator in the non-transmission time is, therefore, 6(=2+4), and as shown in the gradation display field 12, blue is visualized as gradation of 6/7.

As shown in a third pattern (Red), in the same manner, when only the red subfield fr is switched on, as shown in the display color field 11, the display color is red. When the light source 1 is switched off or the intensity of the light from the light source is less than the intensity of the external light, red is visualized as gradation of 5(=4+1)/7 as shown in the gradation display field 12.

As shown in a fifth pattern (Green), in the same manner, when only the green subfield fg is switched on, as shown in the display color field 11, the display color is green. When the light source 1 is switched off or the intensity of the light from the light source 1 is less than the intensity of the external light, green is visualized as gradation of 3(=2+1)/7 as shown in the gradation display field 12.

When only one of the green, red, and blue subfields is not switched and the others are switched on, the following operation is performed. As shown in a fourth pattern (Magenta), when only the green subfield fg is not switched, the display color in the display color field 11 is magenta, and the gradation in the gradation display field 12 is 4/7. As shown in a sixth pattern (Cyan), when only the red subfield fr is not switched, the display color in the display color field 11 is cyan, and the gradation in the gradation displaying field 12 is 2/7. As shown in a seventh pattern (Yellow), when only the blue subfield fb is not switched, the display color in the display color field 11 is yellow, and the gradation in the gradation display field 12 is 1/7. When all the subfields are switched on, the display color in the display color field 11 is white, and the gradation in the gradation display field 12 is 0/7.

As to a condition in which the visualization is made to be possible as the gradation in the gradation display field 12, the field frequency should be faster than a response speed of the human eye. In other words, it is necessary to drive the subfields at a speed such that the integration can be made in the time axis direction so that the human eye does not feel a change in luminance. Since the first embodiment is basically premised on the color display device that adopts the field-sequential driving, the field frequency is 100 Hz that is sufficiently fast, and the gradation shown in the gradation display field 12 can be visualized without changing the driving frequency.

Figure 8:
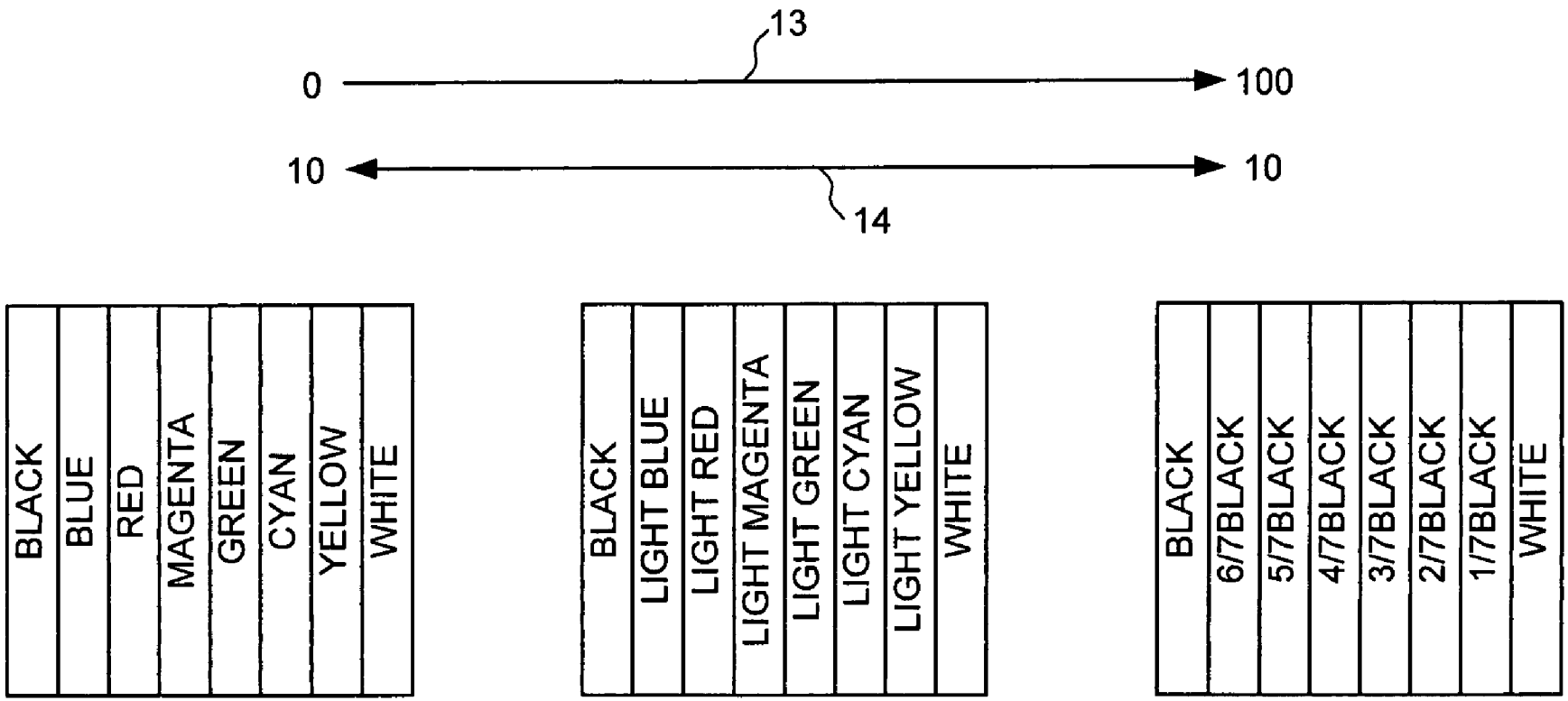
FIG. 8 illustrates display states of the display device according to the present embodiment.
Figure 11:
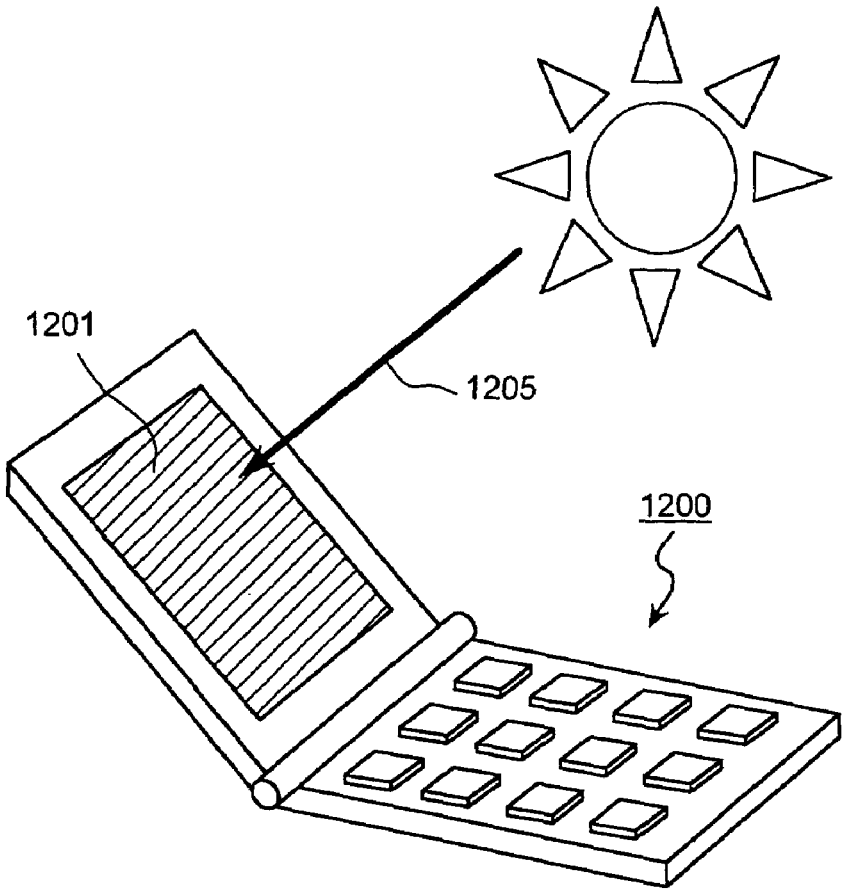
FIG.11 PRIOR ART
FIG. 11 illustrates a problem occurring when the conventional display device used in a cellular terminal.
Figure 12:
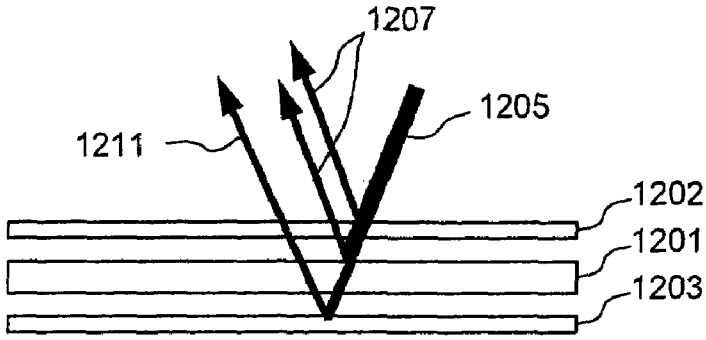
FIG.12 PRIOR ART
FIG. 12 is a schematic diagram of a conventional field-sequential color display device.
Figure 13:
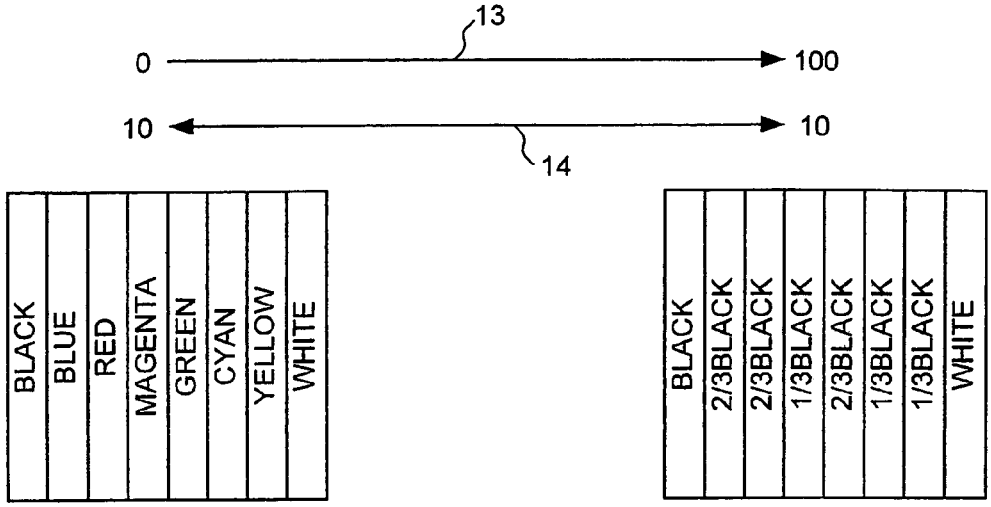
FIG.13 PRIOR ART
FIG. 13 illustrates display states of the conventional display device.
Figure 14:
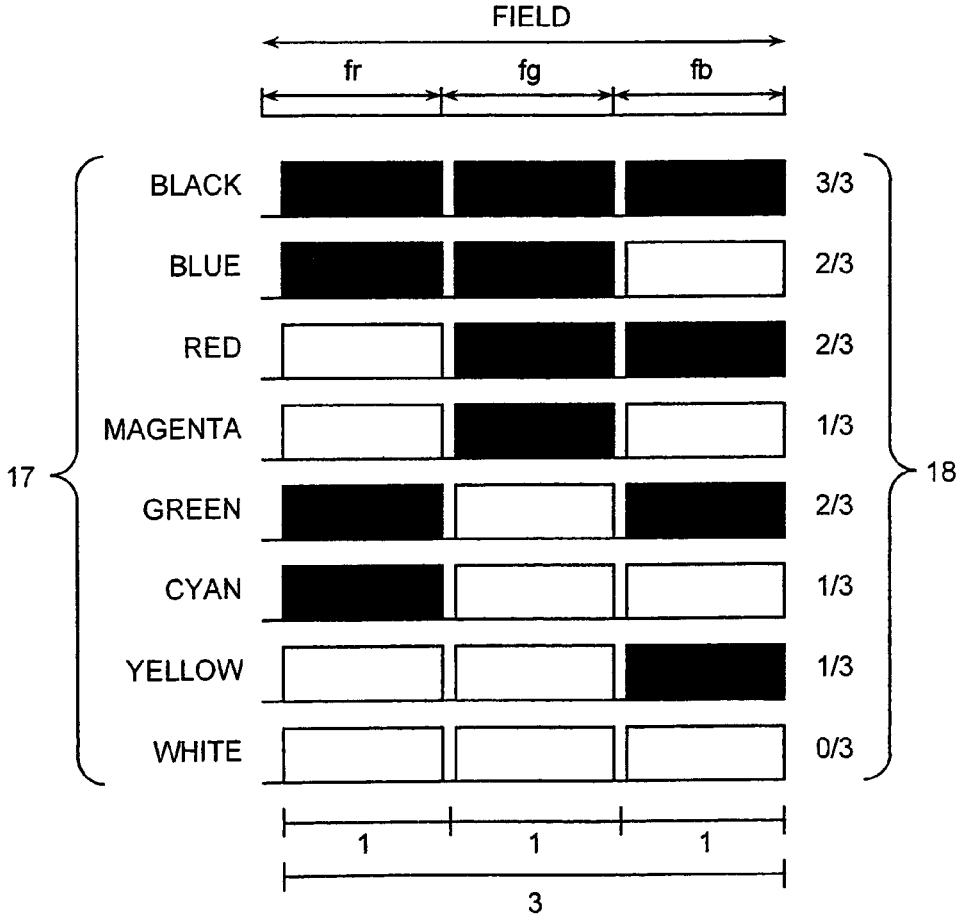
FIG.14 PRIOR ART
FIG. 14 illustrates an operation of the conventional display device.

FIG. 8 illustrates a change of the visualization state of the color bar displaying in the first embodiment according to the intensity of the external light. An arrow 13 represents the intensity of the external light, and it changes from 0 to 100. 0 corresponds to a darkroom without the external light, and 100 corresponds to the outdoors under fine weather. An arrow 14 represents the intensity of the light from the light source 1, and it is always set to be 10. The bottom left of FIG. 8 is a displaying state when the intensity of the external light is 0, and as shown in the display color field 11 of FIG. 7, the color displaying is attained by the light source 1, and eight color bars are displayed.

When the intensity of the external light is 100 and the external light is so bright that the light source 1 can be ignored, as shown in the bottom right of FIG. 8, the colors including from black to white are displayed with gradation as shown in the gradation display field 12 of FIG. 7, so that gray scale displaying of eight gradation is attained. In other words, only luminous components of the color bars are displayed accurately.

The bottom middle of FIG. 8 represents a displaying state in an environment such that the external light is moderately bright and the light from the light source 1 can be visualized. In this case, the colors are visualized as an intermediate displaying state between the bottom left and the bottom right of FIG. 8, and all the colors are visualized as pale colors. Since the luminous components of the color bars are displayed accurately at this time, natural pale color displaying is attained. The state in the bottom middle of FIG. 8 is such that the intensity of the external light is at one point between 0 to 100, and actually the displaying gradually transitions from complete color bar displaying to gray scale displaying while the color saturation is being changed.

The natural color displaying can be, therefore, realized in such a manner while the luminous components are being displayed accurately and the color saturation changes. As mentioned before, the intensity of the external light corresponds to a color adjusting volume in a television unit. According to the first embodiment, however, when the intensity of the outer color is high, the gray scale displaying state in which the colors are narrowed is attained, but when the intensity of the external light is low, the color bar displaying is attained.

Even when the external light becomes stronger in a state that red characters are displayed on a blue background, respective gray scales are displayed with different gradations. Therefore, the characters do not fade and can be visualized.

FIG. 7 and FIG. 8 explain only the display colors of the color bars in a state that two values for transmission and non-transmission are taken out from the subfields. However, since the liquid crystal panel 2 used in the first embodiment can display the pixels with gradation, even when a photographic image is displayed, the full-color displaying is possible. In this case, when the intensity of the external light is strong, the photographic image is displayed by gray scales of multi-gradation. The color saturation is increased or decreased due to a change in the intensity of the external light, while the luminous component is being displayed accurately. The photographic image can be, therefore, displayed with natural hue.

In the present embodiment, the durations of the subfields are set to be different from one another, but in the area "a" of FIG. 4, the light emitting time Tb of the respective LEDs is set to be the same duration regardless of the visibility like a conventional device. Since the light emitting intensity of the LEDs actually differs according to the colors, white balance adjustment or the like is necessary. In the first embodiment, the white balance can be adjusted in such a manner that an electric current from the light source driving circuit 8 that drives the LEDs is adjusted by a light-emitting balance adjusting circuit 10 shown in FIG. 1.

Another approach to adjust the white balance is to change the light emitting time Tb of the LEDs within a range of the displaying time in the subfields. The light emitting time Tb and the displaying time Td of the LEDs are not interlocked but controlled independently. The light-emitting balance adjusting circuit 10 adjusts the light emitting luminance of the light sources for the respective colors, and it is used, for example, when optimum white is desired to be emitted at the time of emitting the red, blue, and green lights sequentially in the subfields. The light-emitting balance adjusting circuit 10 may be a driving current adjusting circuit that adjusts driving current of LED, or a switching-on time adjusting circuit that adjust the switching-on time of LED. The light-emitting balance adjusting circuit 10 may also comprise both the driving current adjusting circuit and the switching-on time adjusting circuit.

In the first embodiment, the semi-transmission reflector 9 is used to reflect the external light, but the present invention is not limited to this method, and for example, a semi-transmission reflecting film may be provided into the liquid crystal panel 2 so as to reflect the external light. The external light may be reflected by the surface of the light guide plate 3 without using any of the semi-transmission reflector 9 and the semi-transmission reflecting film in the liquid crystal panel 2. The method to reflect the external light can be determined arbitrarily. In the present invention, the external light comprises not only the natural light in the outdoors but also all ambient light such as illumination light in the indoors.

Figure 6:
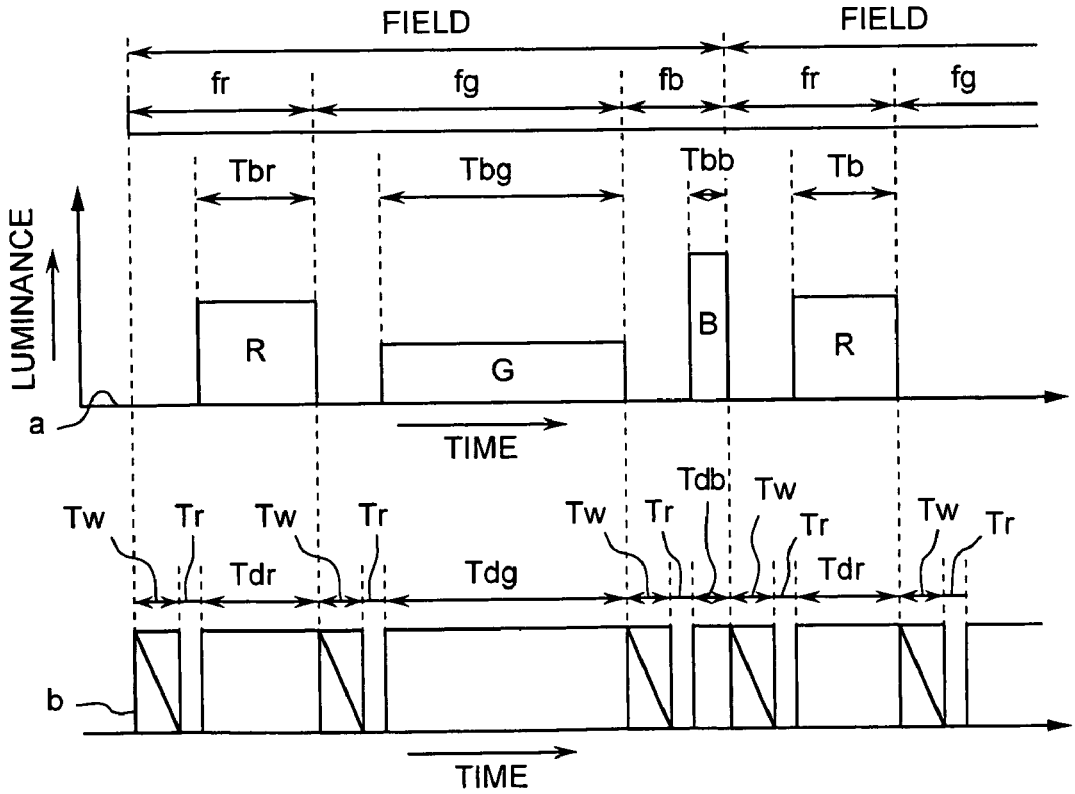
FIG. 6 is illustrates display timing of a display device according to a second embodiment of the present invention.

FIG. 6 is a display timing chart that explains a first embodiment of the present invention. In the display timing chart of the second embodiment, as shown in FIG. 4, the displaying time Td is changeable according to the spectral luminous efficiency characteristics, the LED light emitting time Tb is set to be shorter than the displaying time Td, and the light emitting time Tb for the three LEDs is set to have the same duration. However, in the second embodiment, at the LED light emitting time Tb, the LEDs emit the light for the same duration of the time as the displaying time Td. The setting of the duration of the subfields in FIG. 6 is the same as that in FIG. 4. That is to say, a ratio between the green subfield fg, the red subfield fr, and the blue subfield fb is set to be the ratio of (1).

The switching-on time Tbr, Tbg and Tbb of the LEDs is set to be the same duration of the time as the displaying time Tdr, Tdg and Tdb. The red, blue, and green LEDs to be used in the second embodiment are selected so that the white balance matches with one another when the same electric current is allowed to flow therein. If the ratio between the switching-on time Tb of the LEDs becomes the ratio of (1), the switching-on time for green is the longest, and the switching-on time becomes shorter in order of red and blue, and thus the green, red, and blue colors lose their balance at the time of white displaying. Therefore, the acceptable white displaying cannot be obtained. Specifically, for example, green becomes extremely intense, and thus white becomes greenish.

Figure 3:
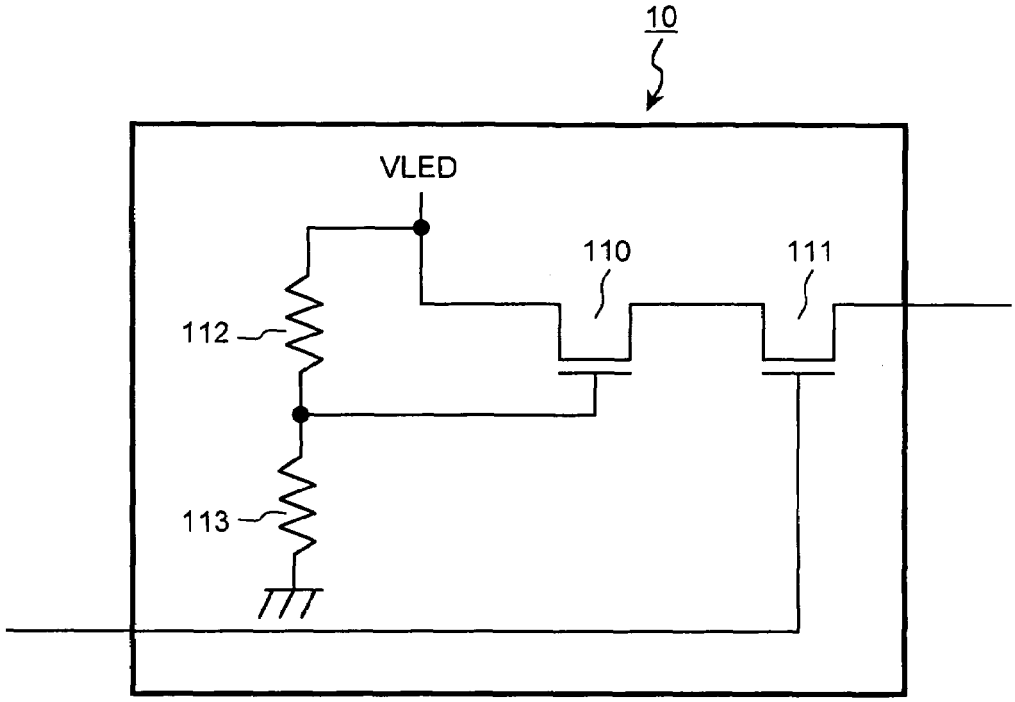
FIG. 3 is a circuit diagram of a light-emitting balance adjusting circuit 10.

In the second embodiment, therefore, the light-emitting balance adjusting circuit 10 adjusts the driving current to adjust the white balance. FIG. 3 is one example of the light-emitting balance adjusting circuit 10. An FET 110 is for electric current adjustment, and a gate voltage at the FET 110 is changed by a voltage that is divided by resistance 112 and resistance 113, so that an electric current flowing from the VLED is changeable. An FET 111 is for a switch, an ON-resistance is not more than 1/20 of that in the FET 110, and the FET 111 switches on or off the light emission of the LEDs based on a control signal from the light source driving circuit 8.

Meanwhile, the switching-on time adjusting circuit adjusts the resistance 112 and the resistance 113 constantly regardless of the light-emitting luminance similarly to the circuit of FIG. 3, and the light source driving circuit 8 connects the control signals that make the switching-on time different per color with the gate signal of the FET 111 for the circuit switch in FIG. 3. In another manner, the electric current may be controlled by a current mirror structure combined with the FET or a bipolar transistor. Otherwise a variable resistance may be used instead of the FET. In methods other than the method of division by the resistance, DC voltage from the outside is connected directly with the FET 110 and the voltage from the outside is controlled to adjust the driving current. As the switch FET 111, except for FET, the bipolar transistor, a relay, a phototransistor or the like may be used.

Even if the light sources for respective colors with various luminance-current characteristics are used, the light-emitting balance adjusting circuit 10 controls the electric current or the switching-on time, or both the electric current and the switching-on time so as to be capable of adjusting the color combined by the field-sequential driving to a desired color.

In this embodiment, the driving current of the green, blue, and red LEDs is adjusted by the resistance 112 and the resistance 113 in the light-emitting balance adjusting circuit 10 and are set so that a quantity of the electric current becomes larger in order of blue, red, and green. The quantity of the electric current in the blue LED whose switching-on time is the shortest becomes large so that the light-emitting luminance of blue rises, and the quantity of the electric current in the green LED whose switching-on time is the longest becomes small so that the light-emitting luminance of green drops, thus optimizing white balance. This electric current adjusting unit can adjust the white balance even in LED other than the LED in which the white balance is optimized by the electric current. Since the switching time of LED is longer than that in the first embodiment, the sufficient luminance can be obtained, and LED that has unacceptable light-emitting efficiency in green but is inexpensive can be used.

FIG. 9 is a schematic diagram of a display device according to a third embodiment of the present invention. A frontlight is used in the light source 1 instead of a backlight. A difference from FIG. 1 of the first embodiment is the configuration of the light source 1, and more specifically, the frontlight 15 is arranged on the visible side of the liquid crystal panel 2, and the reflector 22 is provided below the liquid crystal panel 2. The frontlight 15 includes the red LED 4, the green LED 5, the blue LED 6, and the light guide plate 16. The light guide plate 16 has a prism on the visible side, and the lights from the respective LEDs are guided into the light guide plate 6 and are totally reflected by the prism so as to go out to the liquid crystal panel 2. The LEDs are controlled by the light source driving circuit 8.

When the frontlight 15 is arranged as shown in FIG. 9, the reflecting function precedes the other function in comparison with the backlight system shown in FIG. 1. Needless to say, when the external light is weak, the color displaying is enabled by the field-sequential driving using the frontlight 15. Since the reflection precedes the other function, when the external light is emitted to a certain extent, similar reflection-type gray scale displaying is visualized.

According to this embodiment, the light source 1 that emits a plurality of the color lights and the liquid crystal panel 2 that controls the transmission of the color light emitted from the light source 1 are provided, and one field is divided into a plurality of subfields fr, fg and fb. A specific color light is emitted for at least partial time in the subfield, and the image corresponding to the specific color light is displayed on the liquid crystal panel 2. The durations of the subfields are set so that duration of a subfield in one field is different from duration of any other subfield in the same field, namely, the durations of fr, fg, and fb are set to be different with each other. Reflection-type gradation displaying is executed based on a combination of the durations of the subfields. Even in the display state obtained by the reflection of the external light, therefore, the gray scale displaying is possible according to the visibility of the colors.

The time of the subfield for the color light with higher visibility is preferably set longer than the time of the subfield for the color light with lower visibility. More specifically, the time of the subfield for the emission of the green light is set longer than the time of the subfield for the emission of the red light, and the time of the subfield for the mission of the red light is set longer than the time of the subfield for the emission of the blue light. The duration of the subfield for the emission of the red light, the duration of the subfield for the emission of the green light, and the duration of the subfield for the emission of the blue light are preferably set based on a binary ratio, concretely, the ratio of 4:2:1.

According to the third embodiment, the duration of the subfield comprises the writing time Tw for which image data are written onto the liquid crystal panel 2, and the displaying time Td for which the image is displayed based on the written data. Since the durations of the displaying time Td in the subfields are set so that the duration of the displaying time Td in each subfield composing one field is different each other, the gray scale displaying can be executed, while the white balance is being maintained on the color displaying.

The displaying time Td comprises the light-emitting time Tb for which the color light is emitted, and the non-light emitting time for which the color light is not emitted, and the durations of the non-light emitting time in the displaying time of the subfields may be set to be different each other. Although the durations of the displaying time Td are different from each other in the subfields, the durations of the light-emitting time Tb can be set to be the same in the subfields. Therefore, the balance of white color displayed by synthesizing three colors can be easily suppressed.

The light-emitting balance adjusting circuit 10 is provided, which adjusts the emitting intensity of the color light from the light source 1 for the displaying time in the subfields. The light-emitting balance adjusting circuit 10 adjusts the light-emitting time of the color light from the light source 1 to adjust the emitting intensity of the color light. The light-emitting balance adjusting circuit 10 adjusts the luminance of the color light from the light source 1 during the displaying time in the subfields to adjust the emitting intensity of the color light. The fluctuation of the white balance can be easily suppressed in such a manner, and the gray scale displaying can be executed.

The present invention is applied to the display device in which the gray scale displaying is possible according to the visibility of the colors even in the display state obtained by the reflection of the external light and the visualizing characteristics are excellent even in the external light.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A display device, comprising:

a light source that emits N color lights, where N is a positive integer other than unity; and a displaying unit that controls either of transmission or reflection of the color light from the light source and reflection of an external light, wherein one field is divided into N subfields, a specific color light among the N lights is emitted for at least a partial time of the subfield, a transmission-type color displaying is executed by displaying an image corresponding to the specific color light on the displaying unit, a duration of a subfield is set to be different from a duration of any other subfield in same field, and a reflection-type gradation displaying using the external light is executed based on a combination of the durations of the subfields, wherein a duration of a subfield for a color light with higher visibility is set to be longer than a duration of a subfield for a color light with lower visibility among the N subfields, while a light emitting time for the color light with the higher visibility is set to be equal to a light emitting time for a color light with lower visibility.

2. The display device according to claim 1, wherein the color lights include a green light and a red light, and a duration of a subfield for the green light is set longer than a duration of a subfield for the red light.

3. The display device according to claim 1, wherein the color lights include a green light and a blue light, and a duration of a subfield for the green light is set longer than a duration of a subfield for the blue light.

4. The display device according to claim 1, wherein the color lights include a red light, a green light, and a blue light, a duration of a subfield for the green light is set longer than a duration of a subfield for the red light, and a duration of a subfield for the red light is set longer than a duration of a subfield for the blue light.

5. The display device according to claim 4, wherein the durations of the subfields for the red light, the green light, and the blue light are set based on a visibility ratio of the respective color light.

6. The display device according to claim 5, wherein the visibility ratio is set based on a binary ratio.

7. The display device according to claim 5, wherein the visibility ratio of red:green:blue is approximately 2:4:1.

8. The display device according to claim 1, wherein the light source is a light emitting diode.

9. The display device according to claim 1, wherein the displaying unit is a liquid crystal panel.

10. The display device according to claim 9, wherein the liquid crystal panel has an arrangement to display images by reflecting the external light and display images by transmitting the light from the light source.

11. The display device according to claim 1, wherein the displaying unit has two surfaces, an image is displayed on one surface of the displaying unit and a backlight is arranged towards other surface of the displaying unit.

12. The display device according to claim 1, wherein the displaying unit has a surface to display an image and a frontlight is arranged towards the surface of the displaying unit.

13. A display device, comprising:

a light source that emits N color lights, where N is a positive integer other than unity; and a displaying unit that controls either of transmission or reflection of the color light from the light source and reflection of an external light, wherein one field is divided into N subfields, a specific color light among the N color lights is emitted for at least a partial time of the subfield, a transmission-type color displaying is executed by displaying an image corresponding to the specific color light on the displaying unit, the subfield includes a writing time for which image data are written into the displaying unit and a displaying time for which an image is displayed based on the written data, a duration of a displaying time in the subfield is set to be different from a duration of any other displaying time in the subfield in same field, and a reflection-type gradation displaying using the external light is executed based on a combination of durations of the displaying time in the subfields, wherein the displaying time includes a light-emitting time for which the color light is emitted and a non-light emitting time for which the color light is not emitted, and a duration of a non-light emitting time of the displaying time is set to be different from a duration of any other non-light emitting time of the displaying time in same field.

14. The display device according to claim 13, further comprising:

an adjusting unit that adjusts an intensity of the color light to be output by the light source during the displaying time in each subfield.

15. The display device according to claim 14, wherein the adjusting unit adjusts the intensity of the color light by adjusting duration for which each color light is to be output by the light source during the displaying time in each subfield.

16. The display device according to claim 14, wherein the adjusting unit adjusts the intensity of the color light by adjusting a luminance of the color light to be output by the light source during the displaying time in each subfield.

17. The display device according to claim 13, wherein the light source is a light emitting diode.

18. The display device according to claim 13, wherein the displaying unit is a liquid crystal panel.

19. The display device according to claim 13, wherein the displaying unit has two surfaces, an image is displayed on one surface of the displaying unit and a backlight is arranged towards other surface of the displaying unit.

20. The display device according to claim 13, wherein the displaying unit has a surface to display an image and a frontlight is arranged towards the surface of the displaying unit.

* * * * *